US008171861B2

(12) United States Patent
Rodet

(10) Patent No.: US 8,171,861 B2
(45) Date of Patent: May 8, 2012

(54) RAILWAY VEHICLE POWER BOGIE HAVING A SEMI-SUSPENDED MOTOR

(75) Inventor: Alain Rodet, Chalon sur Saone (FR)

(73) Assignee: Alstom Transport SA, Levallois-Perret (FR)

( * ) Notice: Subject to any disclaimer, the term of this patent is extended or adjusted under 35 U.S.C. 154(b) by 0 days.

(21) Appl. No.: 12/802,367

(22) Filed: Jun. 4, 2010

(65) Prior Publication Data

US 2010/0307370 A1 Dec. 9, 2010

(30) Foreign Application Priority Data

Jun. 5, 2009 (FR) ..... 09 53728

(51) Int. Cl.
*B61F 3/00* (2006.01)

(52) U.S. Cl. ..... 105/182.1; 105/199.1; 105/96.1; 105/136

(58) Field of Classification Search ..... 105/167, 105/182.1, 218.1, 218.2, 219, 223, 224.05, 105/174, 175.1, 96–140
See application file for complete search history.

(56) References Cited

U.S. PATENT DOCUMENTS

| | | | | | |
|---|---|---|---|---|---|
| 1,834,411 | A | * | 12/1931 | Loughridge | 105/4.1 |
| 2,892,420 | A | * | 6/1959 | Cooper | 105/194 |
| 3,661,097 | A | * | 5/1972 | Jackson | 105/199.3 |
| 4,130,065 | A | | 12/1978 | Susdorf et al. | 105/135 |
| 4,170,945 | A | * | 10/1979 | Kayserling | 105/133 |
| 4,228,739 | A | * | 10/1980 | Fitzgibbon | 105/136 |
| 4,278,028 | A | * | 7/1981 | Eichinger et al. | 105/136 |
| 4,353,309 | A | * | 10/1982 | Pollard et al. | 105/136 |
| 4,362,109 | A | * | 12/1982 | Panagin | 105/182.1 |
| 4,398,468 | A | * | 8/1983 | Bell et al. | 105/136 |
| 4,628,824 | A | * | 12/1986 | Goding et al. | 105/168 |
| 4,787,318 | A | * | 11/1988 | Vogel | 105/136 |
| 5,086,706 | A | * | 2/1992 | Boivin | 105/168 |
| 5,181,473 | A | * | 1/1993 | Petit et al. | 105/133 |
| 5,205,220 | A | * | 4/1993 | Wallace | 105/167 |
| 5,235,918 | A | * | 8/1993 | Durand et al. | 105/222 |
| 6,082,766 | A | * | 7/2000 | Rodet et al. | 280/781 |
| 6,637,344 | B2 | * | 10/2003 | Martin | 105/157.1 |
| 2010/0083866 | A1 | * | 4/2010 | Rodet et al. | 105/34.1 |
| 2010/0132585 | A1 | * | 6/2010 | Rodet et al. | 105/133 |
| 2010/0186620 | A1 | * | 7/2010 | Rodet et al. | 105/182.1 |
| 2010/0307370 | A1 | * | 12/2010 | Rodet | 105/96.1 |

(Continued)

FOREIGN PATENT DOCUMENTS

| | | |
|---|---|---|
| DE | 25 14 265 | 10/1976 |

(Continued)

*Primary Examiner* — Mark Le
*Assistant Examiner* — Jason C Smith
(74) *Attorney, Agent, or Firm* — Davidson, Davidson & Kappel, LLC

(57) ABSTRACT

A bogie includes two pairs of wheels (2), the wheels (2) of one pair being connected to one another by a shaft to form an axle (4), the axles (4) being connected to one another by a chassis (6) having at least two side members (10) resting on axle boxes (14, 14') of each axle (4). The boxes (14, 14') are arranged between the wheels (2) of the axle (4), and a motor (24) fixed to the chassis (6) extends between the wheels (2) of the axle (4) and drives the axle (4) in rotation by way of a coupling (42) and a reducing gear (28). One of the axle boxes (14) accommodates the reducing gear (28) of the motor (24).

14 Claims, 3 Drawing Sheets

U.S. PATENT DOCUMENTS

2010/0307371 A1* 12/2010 Rodet ..... 105/133

FOREIGN PATENT DOCUMENTS

| | | |
|---|---|---|
| EP | 0 079 455 | 5/1983 |
| FR | 2 369 133 | 5/1978 |
| GB | 631 977 | 11/1949 |
| WO | WO 87/06550 | 11/1987 |

* cited by examiner

RAILWAY VEHICLE POWER BOGIE HAVING A SEMI-SUSPENDED MOTOR

This claims the benefit of French Patent Application FR 09 53728, filed Jun. 5, 2009 and hereby incorporated by reference herein.

FIELD OF THE INVENTION

The present invention relates to a motorized bogie for a railway vehicle, of the type comprising two pairs of wheels, the wheels of one pair being connected to one another by a shaft to form an axle, said axles being connected to one another by a chassis having at least two side members resting on axle boxes of each axle, said boxes being arranged between the wheels of said axle, a motor fixed to the chassis extending between the wheels of the axle and driving said axle in rotation by way of a coupling and a reducing gear.

The invention relates also to a railway vehicle comprising such a bogie.

BACKGROUND

In a railway vehicle, each motorized bogie is provided with means for driving each axle in rotation. The drive means comprise at least one motor, at least one reducing gear, and a mechanical device for transmitting the driving torque of the motor to the axle and for transmitting the braking torque of the axle to the motor, while permitting relative movements between the motor and the axle induced by the primary suspensions. The drive means differ in the distribution of their masses, which are either "non-suspended", that is to say connected to the axle, or "suspended", that is to say connected to the bogie chassis above the primary suspensions. The drive means differ in their ease of integration into the bogie in terms of space requirement, either by width (that is to say parallel to the axle shaft) or by length (parallel to the direction of travel of the vehicle). They differ in complexity by the number of components they contain.

In order to reduce vertical stresses on the track, it is advantageous to reduce the non-suspended masses. In order to facilitate integration of the drive means, it is advantageous to reduce the space requirements.

The drive known as a "semi-suspended motor" conventionally comprises a motor which rests oscillating on the axle by two bearings and to which there is fixed a reducing gear box. The motor output gear engages with a wheel fixed to the axle. An articulated reaction rod allows the torques to be absorbed and displacements due to movements between the bogie chassis and the axle to be ensured. This transmission is simple to implement but has high non-suspended masses, which limits the speed of the vehicle.

In the so-called "hollow shaft" drive, the reducing gear and the motor are rigidly connected and are fixed to the bogie chassis. The torques are transmitted between the output bearing of the reducing gear and the axle by a hollow-shaft device, which also ensures displacements due to movements between the bogie chassis and the axle. This transmission increases the space requirement of the bogie in the direction of travel of the vehicle. The space occupied by the hollow shaft on the axle also requires the addition of an intermediate wheel to the reducing gear. This solution allows the vehicle to travel at high speeds but it is complex to implement because it requires a hollow bearing at the output of the reducing gear, connections between that bearing and the hollow shaft on the reducing gear side as well as between the axle and the hollow shaft.

The "semi-suspended reducing gear" drive is a compromise between the above two types of drive in terms of non-suspended masses and complexity. The motor is fixed to the bogie chassis and the reducing gear is on the one hand fixed pivotably to the axle and on the other hand is connected to the bogie chassis by a reaction rod. A mechanical coupling connects the motor shaft to the input bearing of the reducing gear and ensures displacements between the motor output and the input of the reducing gear, which displacements are due to the suspensions.

In railway vehicle bogies, the axles of the bogie are generally connected by an "exterior" chassis, in which the side members are arranged outside the wheels, or by an "interior" chassis, in which the side members are arranged inside the wheels, that is to say between the wheels, on axle boxes which are likewise arranged inside the wheels.

The interior chassis enables the mass of the bogie to be lowered and its manufacturing costs to be reduced. Such a chassis also allows the brake callipers to be accommodated outside the chassis, which improves the accessibility of the callipers should they have to be removed, and also improves the accessibility of the wheels. In the case of a power bogie having an interior chassis, there is little space in the transverse direction to accommodate a powerful and bulky motor. The only solution of the prior art which allows a powerful motor, and the associated transmission, to be accommodated, while limiting the non-suspended masses, is hollow-shaft suspension, which is complex to implement, as described above.

SUMMARY OF THE INVENTION

One of the objects of the invention is to remedy those disadvantages by proposing a compact bogie of reduced mass, which has limited non-suspended masses and a simple drive for a powerful motor.

It is an object of the present invention to provide a bogie of the above-mentioned type, in which one of the axle boxes accommodates the reducing gear of the motor.

The space freed in the transverse direction by integrating the reducing gear in the axle box accordingly allows a powerful motor to be accommodated between the wheels of the bogies with a type of drive which on the one hand allows the non-suspended masses to be limited, relative to a solution with a semi-suspended motor, and on the other hand facilitates mounting, as compared with a fully suspended motor.

According to other features of the bogie:

the axle boxes of an axle are connected to one another by a bridge girder, said axle boxes and said bridge girder forming a one-piece transmission bridge which is rigid against torsion about the axle shaft;

the power bogie comprises a primary suspension provided between the chassis and each axle, said primary suspension being designed to permit relative vertical displacement of the axle relative to the chassis;

the chassis comprises two half-chassis each integral with an axle, each half-chassis having two side members connected to one another by a cross-member, each side member resting on the axle boxes of an axle;

the primary suspension comprises two articulated joints arranged respectively between the cross-member and each axle box of a half-chassis, and two rubber blocks placed respectively between the side member of said half-chassis and each axle box;

the cross-members of each half-chassis are articulated with one another by an articulated joint so as to permit rotation of one half-chassis relative to the other about a substantially longitudinal axis;

each side member of a half-chassis is connected to the side member of the other opposite half-chassis by means of a connector articulated with said side members by articulated joints about substantially transverse axes;

the points of connection of the connectors are located in a horizontal plane offset relative to the horizontal plane passing through the articulated joint;

the motor is fixed to a half-chassis by a fixing stirrup, the motor driving in rotation the axle integral with said half-chassis; and the power bogie comprises another motor fixed to the other half-chassis, said motor driving in rotation the other axle by way of a coupling and a reducing gear.

Such an articulated chassis allows the bogie to travel over defects in the tracks—or "distortions"—without incident, by allowing the bogie to have points of support on the ground which are not in the same plane without excessive weight transfers, which increase the risks of derailment of the vehicle. The rolling movement is accordingly absorbed by the articulation of the bogie chassis.

The invention relates also to a railway vehicle comprising at least one bogie as described above.

BRIEF DESCRIPTION OF THE DRAWINGS

Other aspects and advantages of the invention will become apparent from reading the following description, which is given by way of example and with reference to the accompanying drawings, in which.

DETAILED DESCRIPTION OF THE PREFERRED EMBODIMENTS

In the description, the terms "vertical" and "horizontal" are defined relative to a bogie mounted in a railway vehicle. Accordingly, a horizontal plane is substantially parallel to the plane in which the axles extend, and the vertical plane is substantially parallel to the plane in which the wheels extend. The term "longitudinal" is defined relative to the direction in which a railway vehicle extends in a horizontal plane, and the term "transverse" is defined in a direction substantially perpendicular to the longitudinal direction in a horizontal plane.

Figure 1:
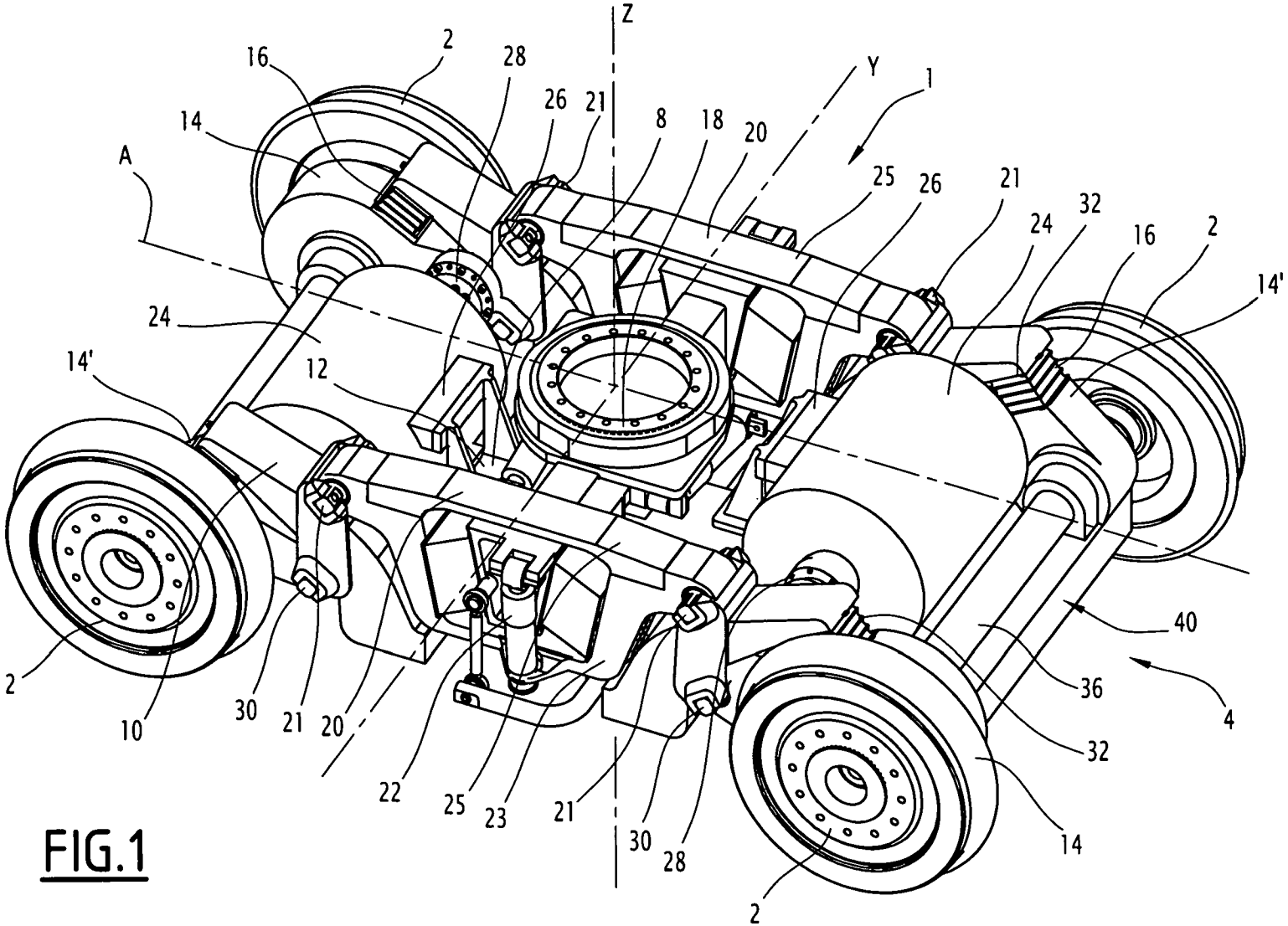
FIG. 1 is a schematic perspective representation of a railway vehicle bogie according to a first embodiment of the invention.

With reference to FIG. 1, a motorized bogie 1 of a railway vehicle (not shown), for example a subway vehicle, is described.

The bogie 1 comprises two pairs of wheels 2, the wheels 2 of each pair being connected to one another by a shaft 36 to form an axle 4. The axles 4 are connected to one another by a chassis 6 (see FIG. 2), called an interior chassis, which comprises two half-chassis 8 each integral with an axle 4. Interior chassis is understood as meaning that the chassis 6 extends substantially between the wheels 2 in the transverse direction without "projecting" beyond them.

Figure 2:
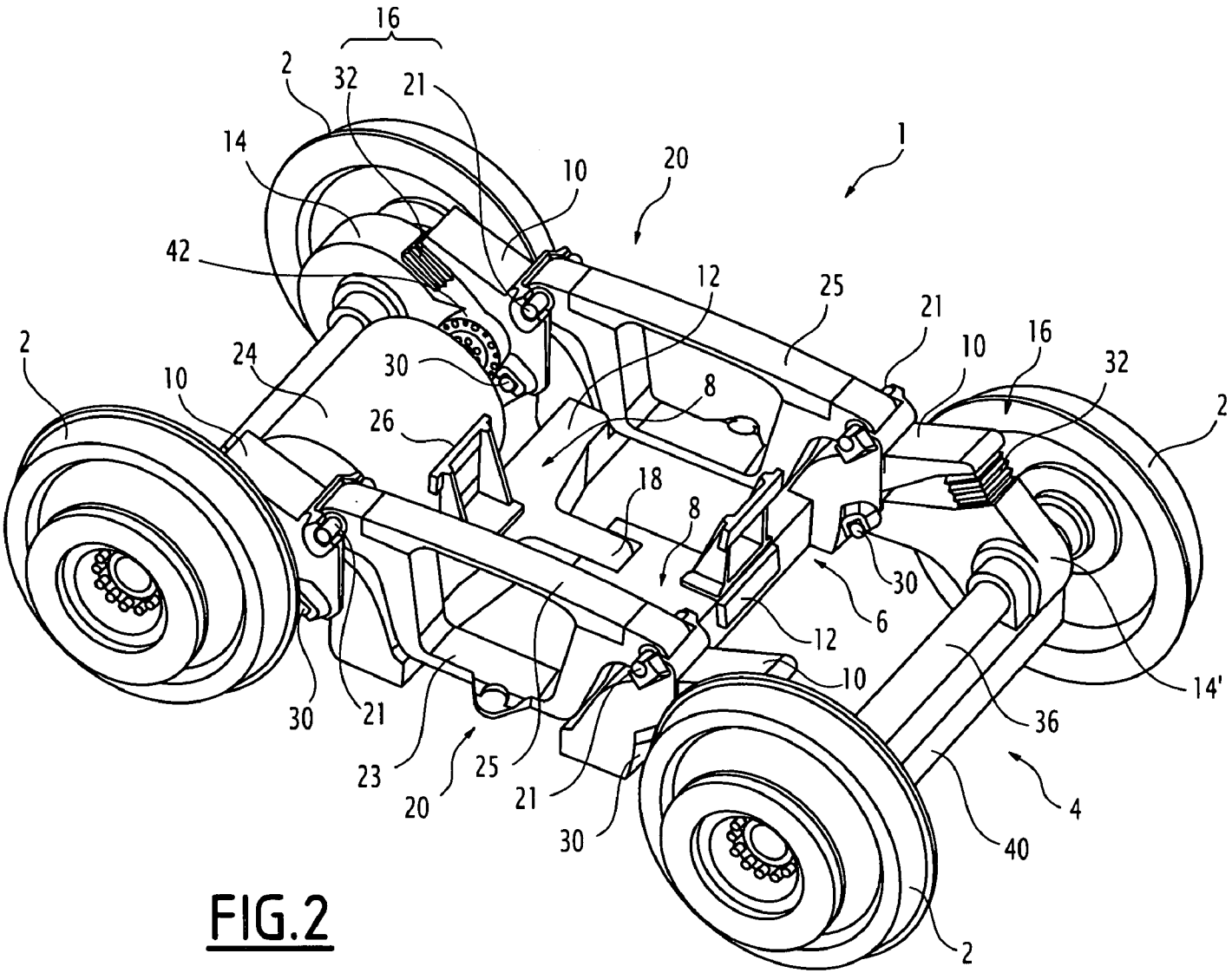
FIG. 2 is a schematic perspective representation of a railway vehicle bogie according to a second embodiment of the invention.

Each half-chassis 8 comprises two side members 10 which extend substantially longitudinally and are connected to one another by a cross-member 12, which extends substantially transversely. Each side member 10 rests on the axle boxes 14, 14' of an axle 4, said axle boxes 14, 14' being arranged substantially against the wheels 2 of the axle 4, between said wheels 2. The cross-member 12 extends at a height lower than that of the side members 10, as is shown in FIG. 2, which allows a larger space to be freed between the two axles 4 of the bogie 1.

A primary suspension 16 is interposed between each side member 10 and the axle box 14, 14' on which said side member 10 rests. The primary suspension 16 allows vertical displacement of the axle relative to the half-chassis 8, that is to say the axle 4 is movable and suspended relative to the half-chassis in a substantially vertical direction.

The cross-members 12 of the half-chassis 8 are articulated with one another by an articulated joint 18, or ball-and-socket joint, arranged in the centre of the bogie, so as to permit rotation of one half-chassis 8 relative to the other about a substantially longitudinal axis A, said rotation permitting adaptation to the distortions to which the bogie is subjected. The articulated joint can be of the dry ball-and-socket type or of the spherical or cylindrical articulated rubber joint type. The ball-and-socket joint blocks the three translational movements along the substantially longitudinal axis A, transverse axis Y and vertical axis Z of the two half-chassis relative to one another.

The side members 10 of the opposing half-chassis 8 are connected to one another by two connectors 20 so as to block the relative rotations of the two half-chassis about the substantially vertical axis Z and the substantially transverse axis Y passing through the articulated joint 18. The two half-chassis are then maintained one on the other so that the axles remain parallel and the bogie 1 does not fold in on itself under the effect of the vertical load. On the other hand, the two half-chassis are able to rotate relative to one another about the substantially longitudinal axis A in order to accept distortions of the track.

To that end, the points of connection of the two connectors 20 are located in a horizontal plane offset relative to the horizontal plane passing through the articulated joint 18. According to the embodiment shown in the figures, the points of connection of the two connectors 20 are located in a horizontal plane which extends above the horizontal plane passing through the articulated joint 18. According to another embodiment, the points of connection of the two connectors extend in a plane which extends below the horizontal plane passing through the articulated joint 18. The connectors are also spaced from one another in the transverse direction. The difference in height H between the horizontal plane of the points of connection of the connectors 20 and the horizontal plane passing through the articulated joint 18 should be sufficient to limit the stresses to which the connectors 20 and the articulated joint 18 are subject under the effect of the vertical load. The distance H should approximately be at least equal to ⅙ of the wheel base of the bogie. The spacing L between the two connectors should be sufficient to limit the stresses to which the connectors and the articulated joint are subject under the effect of the stresses of taking curves, for example. The spacing should approximately be equal to ⅓ of the wheel base of the bogie for a bogie travelling on a track of normal gauge, that is to say having a track gauge of 1435 mm.

The connectors 20 are connected to the side members 10 by articulated joints 21, principally about substantially transverse axes, in order to allow the desired principal freedom of the two half-chassis 8 relative to one another for travelling over distortions of the track. The articulated joints 21 of the connectors can be of the dry ball-and-socket type or of the spherical or cylindrical articulated rubber joint type.

According to an embodiment of the invention shown in FIG. 1, the connectors 20 have, for example, a stirrup shape permitting the accommodation of a secondary suspension 22 in each of said connectors 20. The secondary suspension is then said to be "integrated" into each connector 20, as shown in FIG. 1. In this example, each connector 20 is composed of two elements, a first, stirrup-shaped element 23 connected to the side members 10 by the articulated joints 21, and a second element 25 which is arranged on the two upper parts of the stirrup 23 and connects said parts together. The purpose of the second element 25 is to avoid spreading of the stirrup under the effect of the longitudinal stresses produced by the secondary suspension 22. The secondary suspensions 22 permit inter alia a relative vertical displacement of the bogie 1 relative to the railway vehicle on which said bogie 1 is mounted. The secondary suspension 22 can be of the pneumatic type or of the elastomer suspension type.

The primary suspension 16, which absorbs only vertical displacements, is interposed between each side member 10 and the axle box 14, 14' on which said side member 10 is resting. The primary suspension 16 is here formed by an assembly composed of two articulated joints 30 of the cylindrical rubber type, for example, which are arranged between the cross-member 12 and each axle box 14, 14', which delimit a transverse axis of rotation of the axle 4 relative to the bogie half-chassis 8, and two rubber blocks 32, for example, located between the side member 10 of the half-chassis 8 and each axle box 14, 14'. The primary suspension 16 permits relative vertical displacement of the axle 4 relative to the half-chassis 8, that is to say the axle 4 is suspended relative to the chassis in a substantially vertical direction. The primary suspension 16 is particularly compact.

It also has the advantage of allowing the non-suspended masses to be reduced, which is an important advantage especially in the case of a motorized bogie.

Such a bogie architecture makes it possible especially to limit the angular displacements between the axis of the motor 24 and the axis of the axle 4.

The described bogie is a power bogie, that is to say at least one of the axles 4 is driven in rotation by a motor 24. According to the embodiment shown in FIG. 2, only one axle is driven by a motor 24, while according to the embodiment shown in FIG. 1, the two axles 4 of the bogie 1 are each driven by a motor 24. Each motor is arranged transversely, that is to say its rotating shaft extends parallel to the axle that it drives.

The motor 24 is, for example, fixed relative to the chassis of the bogie 1, fixed, for example, to a cross-member 12 of a half-chassis 8 by a fixing stirrup 26, and extends close to the axle 4 that it drives, substantially between the two wheels 2.

A reducing gear 28 is located in one of the two axle boxes 14 of the axle 4 driven by the motor 24. The bearings 38 of the axle box 14 also serve as bearings for the toothed wheel of the reducing gear 28. Accordingly, the reducing gear 28 can be placed as close as possible to the wheel 2. The arrangement of the reducing gear 28 in an axle box 14 allows a saving to be made in terms of space, which frees space in the transverse direction. The reducing gear box accordingly acts as the axle box, providing connections with the bogie chassis 6 by way of the articulated joints 30 of the primary suspension 16.

Figure 3:
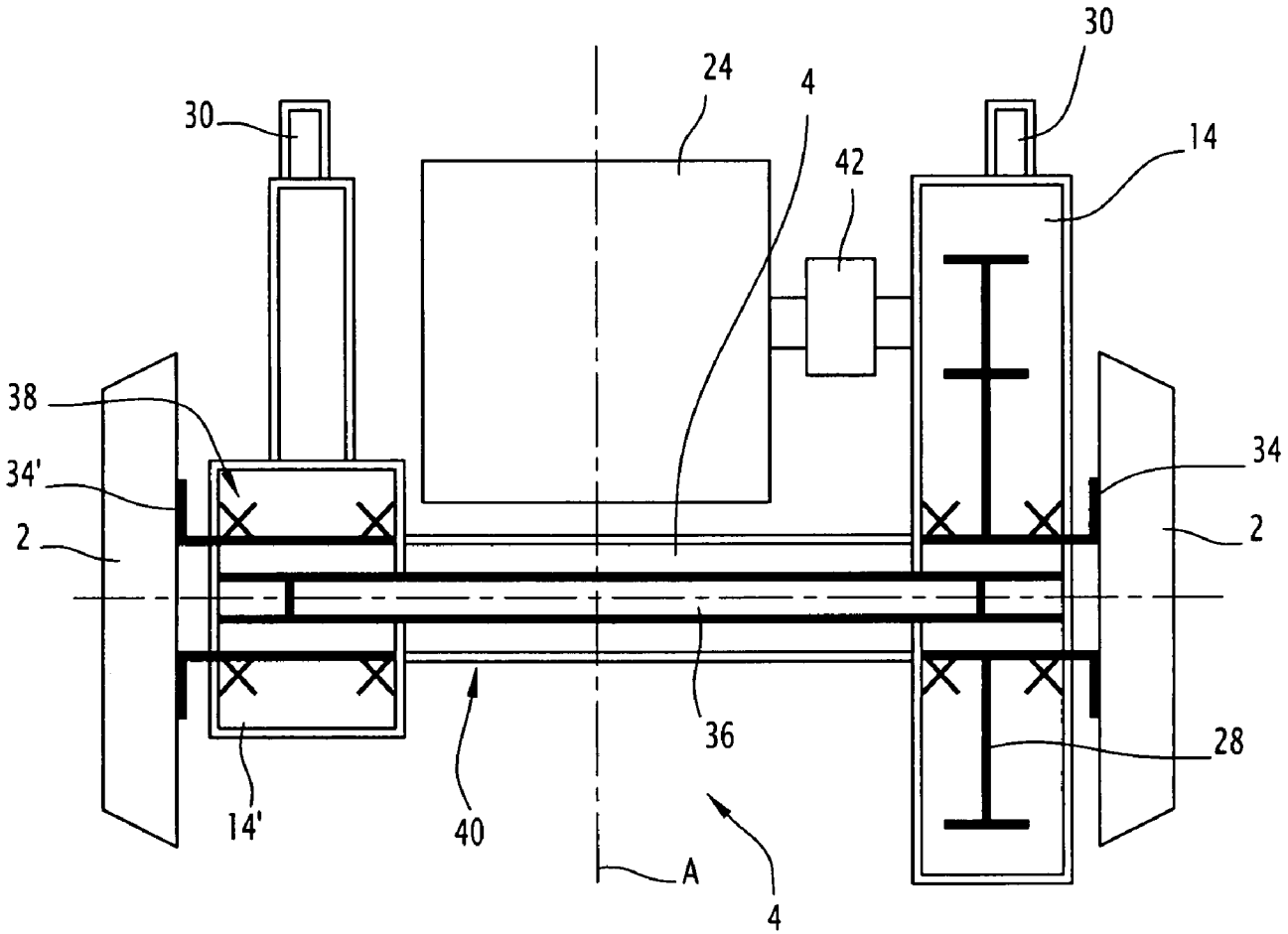
FIG. 3 is a schematic top representation of an axle driven by a motor and of the transmission between said motor and said axle.

As shown in FIG. 3, a coupling 42 is provided between the motor 24 and the reducing gear 28. The coupling is, for example, of the curved tooth type or is of any other type that absorbs slight displacements between the bogie chassis and the axle.

The drive is described below:

the rotating shaft of the motor 24 is connected at the output to the input of the coupling 42, the output of the coupling 42 is connected to the input shaft of the reducing gear 28, the terminal gear of the reducing gear 28 is connected to a hub 34, which is fixed on the one hand to the centre of the wheel 2 and is mounted coaxially on the other hand on a transmission shaft 36, for example a fluted transmission rod, the transmission shaft 36 is connected at its opposite end to a second hub 34', which is itself fixed to the centre of the opposite wheel 2.

The hubs 34 and the transmission shaft 36 are rigidly connected and are therefore driven in rotation by the motor 24.

The two axle boxes 14, 14' of the same axle 4 are connected by a bridge girder 40 to form a dimensionally stable structure. The hubs 34 and the transmission shaft 36 rotate inside the bridge girder 40 by means of bearings 38, which are arranged in the axle boxes 14, 14'. Because the axial boxes 14, 14' are functionally different, the bearings 38, 38' are not necessarily identical.

Moreover, each axle box 14, 14' is connected to the bogie chassis 6 by means of an articulated joint 30, described above.

The assembly comprising the axle box 14 including the reducing gear 28, the bridge girder 40 and the opposite axle box 14 forms a one-piece transmission bridge which is rigid against torsion about the axle shaft. The value of the rigidity of the assembly is defined by the person skilled in the art in order to absorb the rolling movements and allow the vehicle to travel over distortions about a longitudinal axis, taking into account the articulation of the bogie chassis in two half-chassis. Because such a bogie architecture minimizes rolling displacements, the displacements of the coupling 42 are also minimized. These small movements allow a toothed coupling to be fitted between the motor and the reducing gear, which absorb few angular displacements.

Such a transmission arrangement is particularly compact. The power bogie according to the invention accordingly comprises a lightweight interior chassis 6, a powerful and suspended motor 24, and a semi-suspended reducing gear 28, as well as a transmission that is simple to implement.

Another advantage is a space saving in terms of height of the primary or secondary suspensions, because the rolling movements between the axle and the bogie chassis are limited by the rigidity of the assembly axle boxes—bridge girder—connectors. The transmission is also of reduced length owing to the reduced vertical clearance obtained by the primary suspension 16 in the region of the coupling 32.

By way of variation, it is possible for the transmission shaft 36 to be arranged not on the inside of the bridge girder 40 but on the outside, for example above the bridge girder 40, as is shown in FIG. 1.

By way of variation, the bogie chassis is not articulated. In that case, the transmission assembly must have minimal torsional flexibility in order to absorb the rolling movements and allow the vehicle to travel over distortions.

What is claimed is:

1. A power bogie of a railway vehicle, comprising:

a chassis having at least two side members;

a first pair and a second pair of wheels, the wheels of the first pair being connected to one another by a first shaft to form a first axle, the wheels of the second pair being connected to one another by a second shaft to form a second axle, each axle having two respective axle boxes arranged between the first and second pair of wheels of the respective first and second axles, the first and second axles being connected to one another by the chassis, the at least two side members resting on the respective axle boxes of the first and second axles; and a motor fixed to the chassis extending between the first or second pair of wheels of the first or second axle and driving one of the first or second axles in rotation by way of a coupling and a reducing gear, one of the axle boxes housing the reducing gear and housing bearings, the bearings allowing a transmission shaft to rotate and the bearings serving as bearings for a toothed wheel of the reducing gear.

2. The power bogie as recited in claim 1 further comprising a bridge girder connecting the axle boxes of one of the first or second axles, the bridge girder forming a one-piece transmission bridge rigid against torsion about the respective shaft of the first or second axle.

3. The power bogie as recited in claim 1 further comprising a primary suspension provided between the chassis and each of the first and second axles, the primary suspension designed to permit relative vertical displacement of at least one of the first or second axles relative to the chassis.

4. The power bogie as recited in claim 3 wherein the chassis includes two half-chassis each integral with a respective axle, each half-chassis having two side members connected to one another by a cross-member, each side member resting on the axle boxes of the respective axle.

5. The power bogie as recited in claim 4 wherein the primary suspension includes two articulated joints arranged respectively between the cross-member and each axle box of a respective half-chassis, and two rubber blocks placed respectively between the side member of the respective half-chassis and each respective axle box.

6. The power bogie as recited in claim 4 wherein the cross-members of each half-chassis are articulated with one another by an articulated joint so as to permit rotation of one half-chassis relative to the other about a substantially longitudinal axis.

7. The power bogie as recited in claim 6 wherein each side member of one of the two half-chassis is connected to the side member of the other opposing half-chassis by a connector articulated with the side members by further articulated joints about substantially transverse axes.

8. The power bogie as recited in claim 7 wherein points of connection of the connectors are located in a horizontal plane offset relative to a horizontal plane passing through the articulated joint.

9. The power bogie as recited in claim 4 further comprising a fixing stirrup fixing the motor to one of the half-chassis, the motor driving in rotation the axle integral with the one half-chassis.

10. The power bogie as recited in claim 9 further comprising another motor fixed to the other of the two half-chassis, the motor driving in rotation the other axle of the other of the two half-chassis by way of a further coupling and a further reducing gear.

11. A railway vehicle comprising at least one bogie as recited in claim 1.

12. The power bogie as recited in claim 1 wherein a rotating shaft of the motor extends parallel to the axle driven by the motor.

13. The power bogie as recited in claim 1 wherein the motor extends along the first or second shaft of the first or second axle, respectively.

14. The power bogie as recited in claim 1 wherein the axle box that houses the reducing gear is associated with the axle driven by the motor.

* * * * *